United States Patent [19]

Anzenberger, Sr. et al.

[11] 4,151,101

[45] Apr. 24, 1979

[54] METHOD AND COMPOSITION FOR CONTROLLING FOAM IN NON-AQUEOUS FLUID SYSTEMS

[75] Inventors: Joseph F. Anzenberger, Sr., New City; Michael P. Silvon, Mahopac, both of N.Y.

[73] Assignee: Stauffer Chemical Company, Westport, Conn.

[21] Appl. No.: 863,551

[22] Filed: Dec. 23, 1977

[51] Int. Cl.[2] ..... C10M 1/10

[52] U.S. Cl. ..... 252/49.6; 252/51.5 A; 252/358

[58] Field of Search ..... 252/49.6, 51.5 A, 358

[56] References Cited

U.S. PATENT DOCUMENTS

| | | | |
|---|---|---|---|
| 2,416,503 | 2/1947 | Trautman et al. | 252/49.6 |
| 3,231,508 | 1/1966 | Lew | 252/358 X |
| 3,235,501 | 2/1966 | Waldmann | 252/49.6 |
| 3,235,502 | 2/1966 | Waldmann | 252/49.6 |
| 3,697,440 | 10/1972 | Lichtman et al. | 252/358 X |
| 3,923,672 | 12/1975 | Durr et al. | 252/51.5 A X |
| 3,931,022 | 1/1976 | Chesluk et al. | 252/49.6 X |
| 4,062,785 | 12/1977 | Nibert | 252/49.6 |

*Primary Examiner*—Delbert E. Gantz
*Assistant Examiner*—Andrew Metz
*Attorney, Agent, or Firm*—Michael E. Zall

[57] ABSTRACT

An improved method and composition for controlling foam in non-aqueous fluid systems having a tendency to foam. The improved method consists of adding to the system a foam control composition containing an organo-silicone antifoam agent and an alkanolamide. A method is also provided for inhibiting foam formation in such non-aqueous fluid systems by adding to the system an alkanolamide.

56 Claims, No Drawings

METHOD AND COMPOSITION FOR CONTROLLING FOAM IN NON-AQUEOUS FLUID SYSTEMS

BACKGROUND OF THE INVENTION

1. Field of the Invention

This invention relates to improved methods and compositions for controlling foam in non-aqueous fluid systems. More particularly this invention relates to improved methods and compositions for controlling foam in synthetic phosphate ester functional fluids, particularly under conditions of use found in gas turbine lubricating systems.

2. Description of the Prior Art

Many industrial systems are particularly susceptible to foaming problems even under mild conditions of agitation. These problems can be substantial in that they do not allow full utilization of the particular equipment or process involved. In order to counteract foaming problems it is often necessary to resort to chemical treatment for the control of foam. In such chemical treatment, it is highly desirable to reduce existing foam to a low level in a short period of time, i.e. defoam, and to inhibit the foam formation over an extended period of time. Many chemical treatments are, however limited in that only one of the aforementioned effects predominate.

Most functional fluid systems, such as cooling, lubricating hydraulic fluid and heat transfer systems, have a tendency to foam, thus necessitating the addition of foam control compositions to such systems. Gas turbine lubricating systems, for example, present a difficult problem in foam inhibition in that the lubricating fluid is usually continuously filtered. Typically foam control compositions for gas turbine lubricating systems are filtered out fairly rapidly, thus limiting their foam inhibiting properties.

Generally, synthetic phosphate esters are used in functional fluid systems, particularly triaryl phosphates. Triaryl phosphates and their use as functional fluids are described in:

U.S. Pat. No. 2,071,023 to Bass
U.S. Pat. No. 2,938,871 to Matuzzak;
U.S. Pat. No. 3,012,057 to Fierce et al;
U.S. Pat. No. 3,071,549 to Stark;
U.S. Pat. No. 3,468,802 to Nail;
U.S. Pat. No. 3,576,923 to Randall et al;
U.S. Pat. No. 3,723,315 to Sullivan;
U.S. Pat. No. 3,780,145 to Malec;
U.S. Pat. No. 3,931,023 to Dounchis; and
U.S. Pat. No. 3,992,309 to Dounchis.

The entire disclosures of all of the aforementioned patents are incorporated herein by reference.

Organo-silicone antifoam agents, and their use in controlling foam in non-aqueous fluids, such as functional fluids, is described in U.S. Pat. No. 2,357,007 to Larsen. In particular, it is known to use such organo-silicone antifoam agents for controlling foam in synthetic phosphate ester functional fluids, such as triarylphosphates, particularly in gas turbine lubricating systems. (U.S. Pat. Nos. 3,931,023 and 3,992,309). Such organo-silicone antifoam agents however tend to filter out of the system and thus do not provide long term inhibition of foaming.

Fatty acid monoalkanolamides and fatty acid dialkanolamides are known foam stabilizing agents in aqueous detergent compositions. Such stabilizing agents are used to improve the persistence and stability of foam produced in aqueous wash liquours. It is also known that these stabilizing agents, when used in combination with certain amine oxides, produce detergent compositions for aqueous systems which not only have foam stability but also reduced foaming capacity. (U.S. Pat. No. 3,470,102 to Heinze.)

It is an object of this invention to provide an improved foam control composition for controlling foam in non-aqueous fluid compositions.

It is another object of this invention to provide an improved non-aqueous fluid composition having decreased foaming tendencies.

It is still another object of this invention to provide a method of inhibiting the foaming tendencies of non-aqueous fluids.

Further objects will be apparent from the following description of the invention.

SUMMARY OF THE INVENTION

It has now been found that the foregoing objects can be attained by the methods and compositions of this invention.

A specific method of this invention is directed to an improved method of inhibiting the foaming tendency of non-aqueous fluid system having a tendency to foam. The fluid system is of the type wherein a foam control composition containing an organo-silicone antifoam agent has been added to the system. The improvement comprises adding to the system a foam inhibiting amount of an alkanolamide having the structure:

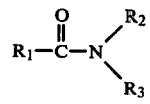

wherein $R_1$ is a hydrocarbon group containing from 6 to 26 carbon atoms, $R_2$ is an hydroxy substituted alkyl of 1 to 6 carbon atoms and $R_3$ is hydrogen or hydroxy substituted alkyl of 1 to 6 carbon atoms.

This invention is additionally directed to the improved non-aqueous fluid compositions produced by the aforementioned method.

This invention is also directed to a method of inhibiting foam formation in a non-aqueous fluid system comprising adding to the system a foam inhibiting amount of the aforementioned alkanolamide.

Additionally, this invention is directed to methods and compositions for enhancing the foam inhibiting characteristics of a foam control composition containing an organo-silicone antifoam agent comprising adding to the composition an enhancing amount of the aforedescribed alkanolamide.

DETAILED DESCRIPTION OF THE INVENTION

The use of the term "foam control" as used herein includes the reduction of existing foam to a low level in a relatively short period of time and the inhibition of foam formation over a relatively extended period of time.

The organo-silicone antifoam agents and alkanolamides used in this invention, as previously indicated, are known compounds and may be synthesized through a wide variety of known synthetic routes.

Preferred organo-silicone antifoam agents used in the foam control compositions of this invention are those described in U.S. Pat. Nos. 2,357,007 and 2,702,793, the entire disclosures of which are incorporated herein by reference.

These preferred antifoam agents are organo-silicone oxide condensation products or condensation products of silanols or organo-silicols, including silicones and silicates, having the following structure:

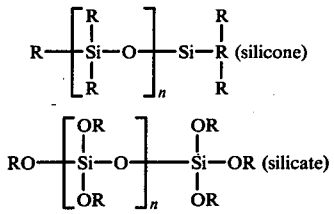

wherein R represents similar or dissimilar organic radicals such as alkyl, aryl, alkaryl, aralkyl and heterocyclic groups; the R's and OR's may be substituted by hydroxyl groups; and n is one or more. Such compounds and their methods of preparation to form compounds of different viscosities are well known to the art. Where R is an aromatic hydrocarbon grouping, intra-substituents such as a halogen, a nitrogen-containing radical as $NO_3$ or $NH_2$, a sulfur-containing radical such as $SO_3H$ or SH, or a phosphorus-containing radical such as phosphite, phosphate or the thio derivative thereof may occur.

Typical antifoam agents include dimethyl silicone, methyl phenyl silicone, ethyl butyl silicone, methyl cyclohexyl silicone, dicyclohexyl silicone, diphenyl silicone, phenyl isopropyl silicone, tolyl butyl silicone, tolyl amyl silicone, phenyl hydroxy ethyl silicone and the corresponding polymers of methyl orthosilicate and ethyl orthosilicate. It is preferred to use in this invention, antifoam agents containing simple organic radicals such as methyl, ethyl and short chain alkyl groups. Such compounds may have hydroxy groups or organic radicals as terminals. It is particularly preferred to utilize a dimethyl silicone anifoam agent.

A particularly preferred organo-silicone antifoam agent for use in this invention is a dimethyl silicone linear polymer chain-stopped with methyl groups, the silicone being mixed with finely divided siliceous material such as silica. A suspension is formed which is relatively inert in contact with known metals and plastics and is relatively non-flammable. If desired, the siliceous material may be omitted.

The aforementioned organo-silicone antifoam agents may range in viscosity from 100 centistokes to 250,00 centistokes (at 40° C.), the higher viscosity compounds, above 900 centistokes, being particularly preferred.

The alkanolamides used in this invention have the structure:

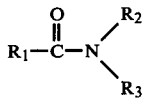

wherein $R_1$ is a hydrocarbon group containing from 6 to 26 carbon atoms, $R_2$ is an hydroxy substituted alkyl of 1 to 6 carbon atoms and $R_3$ is hydrogen or hydroxy substituted alkyl of 1 to 6 carbon atoms.

The alkanolamides used in this invention are the condensation products of:

(a) an hydroxy substituted mono- or dialkanolamine having from 1 to 6 carbon atoms; and (b) a fatty acid having from 6 to 26 carbon atoms.

The fatty acids are the acids normally found in vegetable and animal fats and oils. The fatty acids, for example, can be capric acid, undecyclic acid, lauric acid, tridecylic acid, myristic acid, palmitic acid, stearic acid, arachic acid, behenic acid, cerotic acid, well as mixtures of these acids as they are obtained from natural fats and oils. A preferred fatty acid is the fatty acid derived from coconut oil.

Specific examples of preferred alkanolamides are coconut monoethanolamide, lauric monoethanolamide, tallow monoethanolamide and coconut diethanolamide. A particularly preferred alkanolamide is coconut monoethanolamide.

The foam control compositions of this invention may be used as such without any further compounding or modification. However, in order to treat certain systems more effectively, it is preferred that the foam control compositions be dispersed in a liquid hydrocarbon vehicle. The resultant composition is more readily dispersible in the system to be treated.

The liquid hydrocarbon vehicle is selected to be compatible with the alkanolamide, antifoam agent, and the particular non-aqueous fluid system.

Generally, the liquid hydrocarbon vehicle can be any liquid aliphatic, alicyclic, aromatic hydrocarbon. The vehicle should be liquid at room temperature and atmospheric pressure, have a viscosity of from about 30 to about 400 SUS (Saybolt Universal Seconds at 100° F.) preferably less than 150 SUS, and an average of from about 6 to 25 carbon atoms. Suitable hydrocarbons include hexane heptane, octane, mineral seal oil, stoddard solvent, petroleum naphtha, toluene, xylene, paraffinic mineral oil, naphthenic mineral oil and the like. If desired, mixtures of two or more hydrocarbons can be used.

The foam control compositions of this invention are useful in controlling foam in non-aqueous fluids, particularly functional fluids.

The functional fluids in which the foam control compositions of this invention may be employed include a wide variety of materials such as esters of phosphorus acids, mineral oils, synthetic hydrocarbon oils, silicates, silicones monoesters, dicarboxylic acid esters, chlorinated biphenyls, esters of polyhydric materials, aromatic ethers and thioethers.

The foam control compositions are particularly suited for controlling foam in synthetic phosphate ester functional fluids, e.g. phosphate esters derived from alkylated phenols.

The most common phosphate esters employed are the triesters of orthosphosphoric acid, in particular trialkyl phosphates, triaryl phosphates, and mixed alkylaryl phosphates. The esters have the structure:

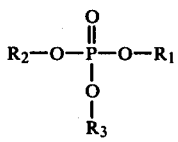

wherein $R_1$, $R_2$ and $R_3$ are each selected from the group consisting of substituted and unsubstituted alkyl and substituted and unsubstituted aryl groups. All three groups may be the same, or all three different, or two groups may be alike and the third different. A typical functional fluid will contain at least one species of phosphate ester and usually will be a mixture of two or more species of phosphate esters.

The phosphate esters usually have a total carbon content of 3–36 carbon atoms.

The individual alkyl groups usually have 1–12 carbon atoms. Substituted alkyl groups can be employed. The alkyl groups can be substituted with halogens, especially chlorine and fluorine, and with alkoxy groups, i.e. butoxyethyl, benzoxyethyl, 2-chloroethyl and 2-fluoroethyl.

Individual aryl groups will usually have 6–12 carbon atoms. Examples of suitable aryl radicals which may be used in the triaryl and mixed aryl phosphates, include phenyl, xylyl, cresyl and halogenated phenyl. A commonly used halogenated aryl material is orthochlorophenyl.

Generic examples of the phosphate esters include trialkyl phosphates, triaryl phosphates and mixed alkaryl phosphates. Specific examples include trimethyl phosphate, tributyl phosphate dibutyloctyl phosphate, triphenyl phosphate, phenyl dicresyl phosphate, methyl diphenyl phosphate, dibutylphenyl phosphate, t-butylphenyl diphenyl phosphate and tricresyl phosphate.

The synthetic phosphate ester functional fluid generally contains several phosphate esters mixed together. Usually, one particular ester or several closely related esters will predominate.

The foam control compositions and methods of this invention have been found to be particularly suitable for controlling foam in triaryl phosphate ester functional fluids, particularly under conditions of use found in gas turbine lubricating systems.

In addition to the oxyesters of phosphoric acid, amides and sulfoesters may be employed. The dibasic acid esters derived from sebasic, adipic and azelaic acids are most commonly employed as functional fluids. Suberic, hydroxysuccinic, fumaric and maleic are sometimes used. The alcohols employed are long chain materials such as octyl, decyl, dodecyl, and various oxo alcohols. Short chain alcohols such as butyl, amyl and hexyl, may also be employed. Aromatic alcohols such as benzyl and substituted benzyl alcohols may also be used.

The foam control compositions and methods may also be employed in controlling foam in silicone and silicate functional fluids.

Another class of functional fluids wherein the foam control compositions and method may be employed include the polyphenyl ethers. Examples of these materials include bis(para-phenoxyphenyl)ether, bis(o-phenoxyphenyl)ether, m-phenoxyphenyl-p-phenoxyphenyl ether, m-phenoxyphenyl-o-phenoxylphenyl ether, bis(mis-phenoxyphenyl)ether, p-bis(p-phenoxy)-benzene, mix-bis(mix-phenoxyphenyl)benzene, bis[p-(p-phenoxyphenoxy)phenyl]ether, m-bis[m-(m-phenoxyphenoxy)phenoxyl]benzene, bis]p-(p-phenoxyphenoxy)phenoxy phenyl]ether. The phenyl groups and the polyphenyl ether may be substituted by various substituents including methyl, ethyl, n-propyl, isopropyl, tert-butyl, n-octyl, cyclohexyl cyclopentyl, chloro, bromo, hydroxyl, methoxyl and cumyl.

Hydrocarbon oils, including natural mineral oils obtained from petroleum and synthetic hydrocarbons are also suitable functional fluids. The mineral oils include a wide variety of naphthenic, paraffinic and asphalt base oils.

Synthetic oils which can be employed as functional fluids include alkylated waxes, alkylated hydrocarbons or relatively high molecular weight, hydrogenated polymers of hydrocarbons and condensation products of chlorinated alkyl hydrocarbons with aryl compounds. Other suitable fluids are those obtained by polymerization of low molecular weight alkylene oxides such as propylene and/or methylene oxide. Still other fluids obtained by etherificiation and/or esterification of the hydroxy groups and alkylene oxide polymers, such as, for example, the acetate of the 2-ethylhexanol-initiated polymer of propylene oxide.

Mixtures of the above-mentioned fluids may be employed as well as the pure substances.

The weight ratio of alkanolamide to organo-silicone antifoam agent in the foam control composition and non-aqueous fluid composition depends upon the fluid used in the non-aqueous fluid system and the particular alkanolamide and organo-silicone antifoam agent used. Generally, the weight ratio is sufficiently high to impart to the foam control composition enhanced foam inhibiting characteristics and to decrease the foaming tendency of the non-aqueous fluid composition. Broadly, a weight ratio of alkanolamide to antifoaming agent of about 0.1:1. to about 10.:1. can be utilized and preferably from about 0.5:1. to about 5.:1.

The foam control compositions of this invention are especially adapted to inhibit the formation of foam over an extended period of time and to reduce existing foam within a short period of time.

The foam control compositions of this invention are present in the non-aqueous fluid in foam controlling amounts, which provide to the non-aqueous fluid an effective amount of the alkanolamide for decreasing the foaming tendency of the fluid. In general, from about 1 to about 500 parts of alkanolamide are provided to one million parts of the non-aqueous fluid. A preferred range is from about 1 and about 100 ppm with the most preferred range being from about 5 to about 25 ppm.

The foam control compositions should be added to the system with good mixing as close as possible to the source of the foam. For example, in the gas turbine lubricating system the foam control composition should be added to the sump. The foam control compositions of this invention are easily and accurately proportioned into the foaming media and rapidly disperse in the non-aqueous system so as to produce fast foam elimination.

The following non-limiting examples serve to illustrate the invention.

EXAMPLE 1

The following are examples of improved foam control compositions of this invention:

| FORMULATION A | |
|---|---|
| Ingredient | Wt. % |
| Coconut monoethanolamide | 5.0 |
| Dimethylpolysiloxane(1) | 5.0 |
| Hydrocarbon Vehicle(2) | 90. |
| | 100. |

| FORMULATION B | |
|---|---|
| Ingredient | Wt. % |
| Coconut monoethanolamide | 5.0 |
| Dimethylpolysiloxane(1) | 1.0 |
| Hydrocarbon Vehicle(2) | 94.0 |

-continued

| FORMULATION C | |
|---|---|
| Ingredient | Wt. % |
| Coconut monoethanolamide | 5.0 |
| Dimethylpolysiloxane[1] | 3.0 |
| Hydrocarbon Vehicle[2] | 92. |
| | 100. |

[1]SWS-203 from SWS Silicones Corporation, Adrian, Michigan
[2]Promar No. 5 Process Oil or Rubrex 100 Process Oil from Mobil Oil Company. This is a light mineral oil - 90 to 100 SUS 100° F.

FORMULATING PROCEDURE

The coconut monoethanolamide was mixed with the hydrocarbon vehicle by stirring at up to 150° F. to complete the solubilization of the amides. The heating was then discontinued. Rapid stirring was maintained while the mixture slowly cooled. The alkanolamide re-crystallized as fine particles. The organo-silicone antifoam agent was then added to the mixture and the mixture heated to 80° to 100° F. The mixture was then stirred for an hour to insure homogeneity of the composition.

EXAMPLE 2

A substantially pure synthetic triaryl phosphate ester functional fluid, tert-butylphenyl diphenyl phosphate, was tested and found to have a foaming tendency of 550 ml at 75° C. when tested according to Sequence I procedure of ASTM D-892. The addition of 0.01 weight percent of Formulation A foam Control composition of Example I immediately lowered the foaming tendency to 10 ml foam (five minute blowing period).

A concentration of 0.01 weight percent of Formulation A in the functional fluid provided 5 ppm of the organo-silicone antifoam agent and 5 ppm of the alkanolamide.

EXAMPLE 3

The procedure of Example 2 was followed by utilizing 0.02 weight percent of Formulation A of Example 1. Foaming tendency was reduced to 10 ml of foam.

EXAMPLE 4

The tert-butylphenyl diphenyl phosphate functional fluid of Example 2 was mixed with 0.01 weight percent of Formulation B of Example 1 thus providing 5 ppm of the alkanolamide and 1 ppm of the organo-silicone antifoam agent. The fluid had an immediate foaming tendency of 310 ml. (after five minutes blowing). After three hours the fluid had a foaming tendency of 150 ml. and after four hours the foaming tendency was 80 ml.

EXAMPLE 5

The addition of 0.01 weight percent of Formulation C of Example 1 to the tert butyl phenyl diphenyl phosphate of Example 2 providing 5 ppm of the alkanolamide and 3 ppm of the organo-silicone antifoam agent gave an immediate foaming tendency of 380 ml foam, and 180 ml foam after four hours.

EXAMPLE 6

The addition of 10 ppm of coconut monoethanolamide to tert-butyl phenyl diphenyl phosphate functional fluid immediately reduced the foaming tendency to 480 ml of foam. After 2 hours the foaming tendency was reduced to 320 ml and after 18 hours 180 ml.

EXAMPLE 7

A frame 7001C General Electric gas turbine unit utilizing t-butylphenyl diphenyl phosphate (FYRQUEL® GT from Stauffer Chemical Co., Westport, Conn.) as a lubricating fluid was foaming excessively. The improved foam control composition Formulation A of Example 1 was slowly added to the lubricating fluid at the sump. Sufficient quantity of the foam control composition was added to the lubricating fluid to produce a concentration of 5 parts dimethylpolysiloxane and 5 parts alkanolamide in one million parts lubricating fluid. The foam was immediately reduced. Fifty days after addition of the composition foaming was determined not to be excessive.

Four similar gas turbine units, which were excessively foaming, were similarly treated with 5 parts per million of dimethyl polysiloxane antifoam agent. The foam was immediately reduced. Thirty days after addition of the composition foaming was determined to be excessive in these units.

The foregoing tests indicate that the foam control composition of this invention is superior to the organo-silicone antifoam agent alone.

What is claimed is:

1. A method of enhancing the foam inhibiting characteristics of a foam control composition containing an organo-silicone antifoam agent comprising adding to the composition an enhancing amount of an alkanolamide having the structure:

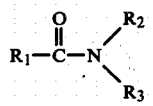

wherein $R_1$ is a hydrocarbon group containing from 6 to 26 carbon atoms, $R_2$ is an hydroxy substituted alkyl of 1 to 6 carbon atoms and $R_3$ is hydrogen or hydroxy substituted alkyl of 1 to 6 carbon atoms.

2. The method of claim 1, wherein said foam control composition contains a liquid hydrocarbon vehicle.

3. The method of claim 1, wherein the antifoam agent is a dimethyl silicone compound.

4. The method of claim 1, wherein the alkanolamide is coconut monoethanolamide.

5. The method of claim 1, wherein the alkanolamide is lauric monoethanolamide.

6. The method of claim 1, wherein the alkanolamide is tallow monoethanolamide.

7. The method of claim 1, wherein the alkanolamide is coconut diethanolamide.

8. The method of claim 1, wherein the antifoam agent is a dimethyl silicone compound and the alkanolamide is coconut monoethanolamide.

9. The method of claim 1, wherein the enhancing amount is provided by a weight ratio of alkanolamide to antifoam agent of 0.1:1 to about 10:1.

10. The method of claim 1, wherein the enhancing amount is provided by a weight ratio of alkanolamide to antifoaming agent of about 0.5:1 to about 5.:1.

11. An improved non-aqueous fluid composition having a decreased foaming tendency, of the type containing a major portion of a non-aqueous functional fluid which is a synthetic phosphate ester having a tendency to foam and further containing an organo-silicone antifoam agent, wherein the improvement comprises the presence in the composition of an effective amount for decreasing foaming tendency of an alkanolamide having the structure:

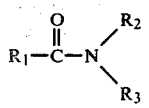

wherein $R_1$ is a hydrocarbon group containing from 6 to 26 carbon atoms, $R_2$ is an hydroxy substituted alkyl of 1 to 6 carbon atoms and $R_3$ is hydrogen or hydroxy substituted alkyl of 1 to 6 carbon atoms.

12. The composition of claim 11, wherein the antifoam agent contains dimethyl silicone.

13. The composition of claim 11, wherein the alkanolamide is coconut monoethanolamide.

14. The composition of claim 11, wherein the alkanolamide is lauric monoethanolamide.

15. The composition of claim 11, wherein the alkanolamide is tallow monoethanolamide.

16. The composition of claim 11, wherein the alkanolamide is coconut diethanolamide.

17. The composition of claim 11, wherein the antifoam agent is a methyl silicone compound and the alkanolamide is coconut monoethanolamide.

18. The composition of claim 17, wherein the synthetic phosphate ester is a triaryl phosphate ester.

19. The composition of claim 11, wherein the synthetic phosphate ester is a triaryl phosphate ester.

20. The composition of claim 19, wherein the triaryl phosphate ester is t-butylphenyl phosphate diphenyl phosphate.

21. The composition of claim 11, wherein the effective amount is provided by a weight ratio of alkanolamide to antifoaming agent of 0.1:1 to about 10.:1.

22. The composition of claim 11, wherein the effective amount is provided by a weight ratio of alkanolamide to antifoaming agent of about 0.5:1 to about 5.:1.

23. The composition of claim 11, wherein the effective amount is from about 1 ppm to about 500 ppm by weight of the non-aqueous fluid.

24. The composition of claim 11, wherein the effective amount is from about 1 ppm to about 100 ppm by weight of the non-aqueous fluid.

25. The composition of claim 11, wherein the effective amount is from about 5 ppm to about 25 ppm by weight of the non-aqueous fluid.

26. An improved method of inhibiting the foaming tendency of a non-aqueous fluid system having a tendency to foam, of the type wherein a foam control composition containing an organo-silicone antifoam agent is added to the system, the improvement comprising adding to the system a foam inhibiting amount of an alkanolamide having the structure:

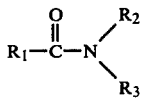

wherein $R_1$ is a hydrocarbon group containing from 6 to 26 carbon atoms, $R_2$ is an hydroxy substituted alkyl of 1 to 6 carbon atoms and $R_3$ is hydrogen or hydroxy substituted alkyl of 1 to 6 carbon atoms.

27. The method of claim 26, wherein the antifoam agent is dimethyl silicone compound.

28. The method of claim 26, wherein the alkanolamide is coconut monoethanolamide.

29. The method of claim 26, wherein the alkanolamide is lauric monoethanolamide.

30. The method of claim 26, wherein the alkanolamide is tallow monoethanolamide.

31. The method of claim 26, wherein the alkanolamide is coconut diethanolamide.

32. The method of claim 26, wherein the antifoam agent is a dimethyl silicone compound and the alkanolamide is coconut monoethanolamide.

33. The method of claim 32, wherein the non-aqueous fluid is a triaryl phosphate ester.

34. The method of claim 26, wherein the non-aqueous fluid is a functional fluid.

35. The method of claim 34, wherein the non-aqueous fluid is a functional fluid containing a synthetic phosphate ester.

36. The method of claim 35, wherein the non-aqueous fluid is a functional fluid containing a triaryl phosphate ester.

37. The method of claim 36, wherein the non-aqueous fluid is a functional fluid containing a triaryl phosphate ester of t-butylphenyl diphenyl phosphate.

38. The method of claim 26, wherein the system is a gas-turbine lubricating system.

39. The method of claim 26, wherein the foam inhibiting amount is provided by a weight ratio of alkanolamide to antifoaming agent of 0.1:1 to about 10:1.

40. The method of claim 26, wherein the foam inhibiting amount is provided by a weight ratio of alkanolamide to antifoaming agent of about 0.5:1 to about 5:1.

41. The method of claim 26, wherein the foam inhibiting amount is from about 1 ppm to about 500 ppm by weight of the non-aqueous fluid.

42. The method of claim 26, wherein the foam inhibiting amount is from about 1 ppm to about 100 ppm by weight of the non-aqueous fluid.

43. The method of claim 26, wherein the foam inhibiting amount is from about 5 ppm to about 25 ppm by weight of the non-aqueous fluid.

44. A method of inhibiting foam formation in a non-aqueous fluid system comprising adding to the system a foam inhibiting amount of an alkanolamide having the structure:

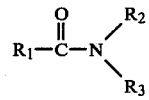

wherein $R_1$ is a hydrocarbon group containing from 6 to 26 carbon atoms, $R_2$ is an hydroxy substituted alkyl of 1 to 6 carbon atoms and $R_3$ is hydrogen or hydroxy substituted alkyl of 1 to 6 carbon atoms.

45. The method of claim 44 wherein the alkanolamide is coconut moneoethanolamide.

46. The method of claim 44, wherein the alkanolamide is lauric monoethanolamide.

47. The method of claim 44, wherein the alkanolamide is tallow monoethanolamide.

48. The method of claim 44, wherein the alkanolamide is coconut diethanolamide.

49. The method of claim 44, wherein the non-aqueous fluid is a functional fluid.

50. The method of claim 49, wherein the non-aqueous fluid is a functional fluid containing a synthetic phosphate ester.

51. The method of claim 50, wherein the non-aqueous fluid is a functional fluid containing a triaryl phosphate ester.

52. The method of claim 51, wherein the non-aqueous fluid is a functional fluid containing a triaryl phosphate ester of t-butylphenyl diphenyl phosphate.

53. The method of claim 44, wherein the system is a gas-turbine lubricating system.

54. The method of claim 44, wherein the foam inhibiting amount is from about 1 ppm to about 500 ppm by weight of the non-aqueous fluid.

55. The method of claim 44, wherein the foam inhibiting amount is from about 1 ppm to about 100 ppm by weight of the non-aqueous fluid.

56. The method of claim 44, wherein the foam inhibiting amount is from about 5 ppm to about 25 ppm by weight of the non-aqueous fluid.

* * * * *

UNITED STATES PATENT AND TRADEMARK OFFICE

CERTIFICATE OF CORRECTION

PATENT NO. : 4,151,101

DATED : April 24, 1979

INVENTOR(S) : Joseph F. Anzenberger, Sr. et al.

It is certified that error appears in the above-identified patent and that said Letters Patent are hereby corrected as shown below:

Col. 3, line 56, "250,00" should be -- 250,000 --; and

In the Claims:

Claim 20, delete "phosphate" second occurrence.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*